US008015931B2

(12) United States Patent
Lin

(10) Patent No.: US 8,015,931 B2
(45) Date of Patent: Sep. 13, 2011

(54) QUICK AND EASY ASSEMBLY SHELVING UNIT AND METHOD FOR ASSEMBLING THE SAME

(76) Inventor: Shih-Ming Lin, Dongguan (CN)

( * ) Notice: Subject to any disclaimer, the term of this patent is extended or adjusted under 35 U.S.C. 154(b) by 341 days.

(21) Appl. No.: 12/391,438

(22) Filed: Feb. 24, 2009

(65) Prior Publication Data

US 2010/0122964 A1 May 20, 2010

(30) Foreign Application Priority Data

Nov. 17, 2008 (CN) ..... 2008 2 0203476 U

(51) Int. Cl.
*A47B 91/00* (2006.01)

(52) U.S. Cl. ..... 108/193; 108/115; 108/184; 312/262

(58) Field of Classification Search ..... 108/115, 108/193, 184, 162, 176, 180, 187; 312/7.2, 312/258, 262; 211/149, 195; 248/150, 166, 248/188.6, 240, 240.3, 240.4, 241; 16/324, 16/326

See application file for complete search history.

(56) References Cited

U.S. PATENT DOCUMENTS

| | | | | |
|---|---|---|---|---|
| 3,602,388 | A * | 8/1971 | Hurkamp | 220/1.5 |
| 5,593,046 | A * | 1/1997 | Katsuura et al. | 211/41.15 |
| 5,664,854 | A * | 9/1997 | Letch | 312/262 |
| 6,238,027 | B1 * | 5/2001 | Kohler et al. | 312/265.1 |
| 7,337,732 | B2 * | 3/2008 | Becker et al. | 108/193 |
| 7,641,295 | B2 * | 1/2010 | Cheng et al. | 312/223.2 |
| 2005/0174019 | A1 * | 8/2005 | Chi-Sheng | 312/258 |
| 2008/0006751 | A1 * | 1/2008 | Chen et al. | 248/278.1 |
| 2008/0035816 | A1 * | 2/2008 | Ciungan | 248/276.1 |
| 2011/0011816 | A1 * | 1/2011 | Marietta et al. | 211/149 |

* cited by examiner

*Primary Examiner* — Hanh V Tran
(74) *Attorney, Agent, or Firm* — Alan Kamrath; Kamrath & Associates PA

(57) ABSTRACT

A shelving unit includes a support frame and a plurality of support boards each mounted on the support frame. The support frame includes a front support bracket, a back board located opposite to the front support bracket, four first connecting tubes each having a first end connected with the respective corner of the front support bracket, and four second connecting tubes each having a first end connected with a second end of the respective first connecting tube and a second end connected with the respective corner of the back board. Thus, the shelving unit can be assembled and disassembled without using tools, thereby facilitating assembling the shelving unit. In addition, the shelving unit can be folded into a smaller overall volume to reduce the cost of packaging, transportation and storage of the shelving unit.

15 Claims, 7 Drawing Sheets

QUICK AND EASY ASSEMBLY SHELVING UNIT AND METHOD FOR ASSEMBLING THE SAME

BACKGROUND OF THE INVENTION

1. Field of the Invention

The present invention relates to a quick and easy assembly shelving unit and, more particularly, to a quick and easy assembly shelving unit to display and store an electronic video or audio appliance, such as a television, video player, speaker and the like.

2. Description of the Related Art

A conventional shelving unit comprises a shelving unit body having an inner portion provided with a plurality of partitions to receive a plurality of electronic appliances, such as video players, speakers and the like. In addition, a television can be placed on the top of the shelving unit body. However, the conventional shelving unit is either in a fully assembled construction or in a knock-down construction and has many shortcomings which dissuades consumers from buying it. For fully assembled construction, it cannot be folded so that the shelving unit has a larger overall volume and occupies a larger storage space. For knock-down construction, it requires tools and takes a considerable amount of time for assembly and disassembly. Therefore, conventional shelving unit causes inconvenience to a user in packaging, transportation and storage of the shelving unit and increasing the cost of fabrication.

BRIEF SUMMARY OF THE INVENTION

In accordance with the present invention, there is provided a shelving unit, comprising a support frame. The support frame includes a front support bracket having four corners, a back board located opposite to the front support bracket and having four corners, four first connecting tubes each having a first end pivotally connected with a respective one of the four corners of the front support bracket, and four second connecting tubes each having a first end pivotally connected with a second end of a respective one of the first connecting tubes and a second end pivotally connected with a respective one of the four corners of the back board.

The primary objective of the present invention is to provide a shelving unit that is foldable while transporting or when not in use.

Another objective of the present invention is to provide a shelving unit, wherein the support frame of the shelving unit can be folded to have a smaller volume to decrease the cost of packaging, transportation and storage of the shelving unit.

A further objective of the present invention is to provide a shelving unit that can be assembled easily and quickly without using tools, thereby greatly facilitating a user on saving a considerable amount of time to assemble and disassemble the shelving unit.

A further objective of the present invention is to provide a shelving unit that can be folded when not in use to save the space of storage, thereby facilitating the user storing and moving the shelving unit.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
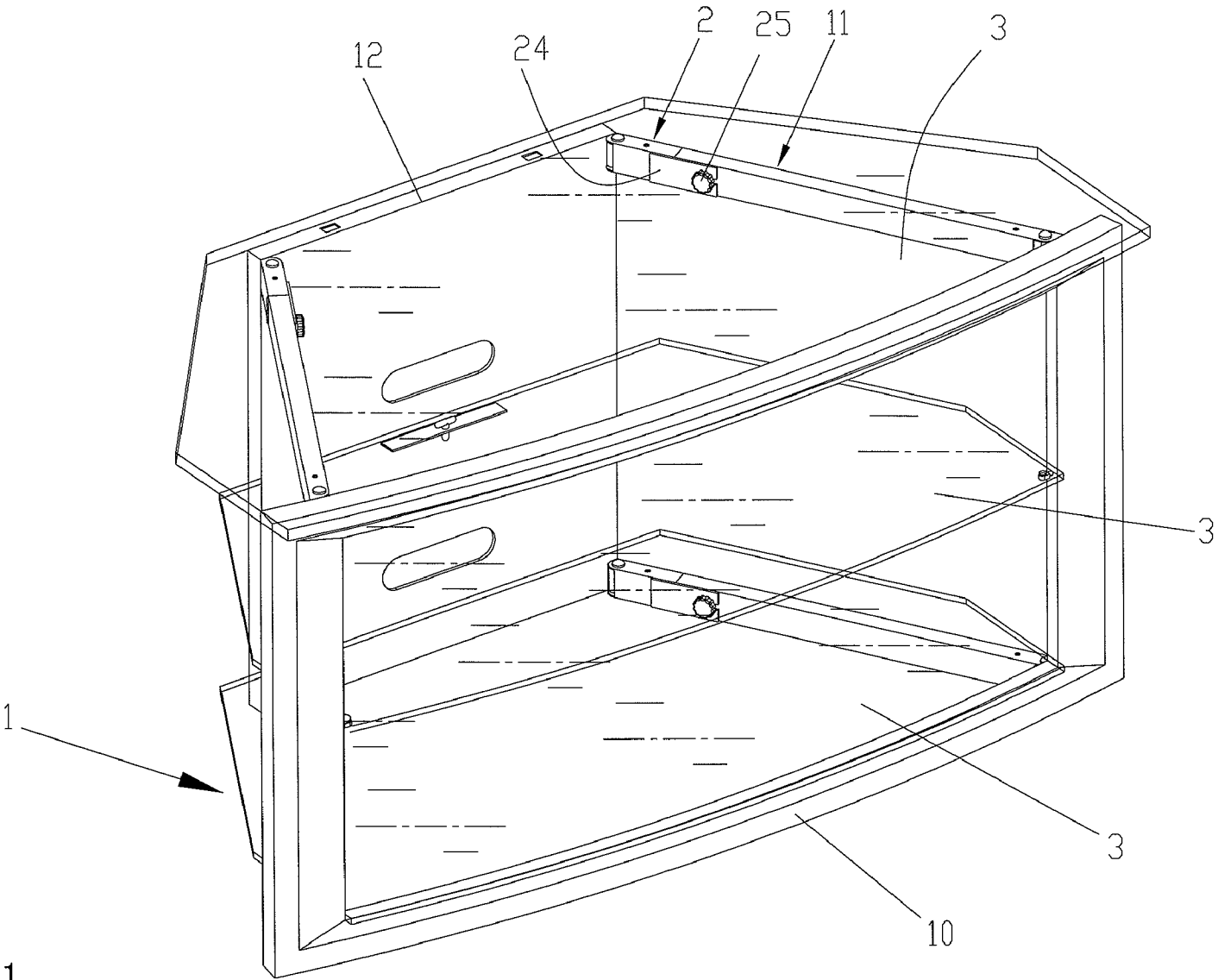
FIG. 1 is a perspective view of a shelving unit in accordance with the preferred embodiment of the present invention.
Figure 2:
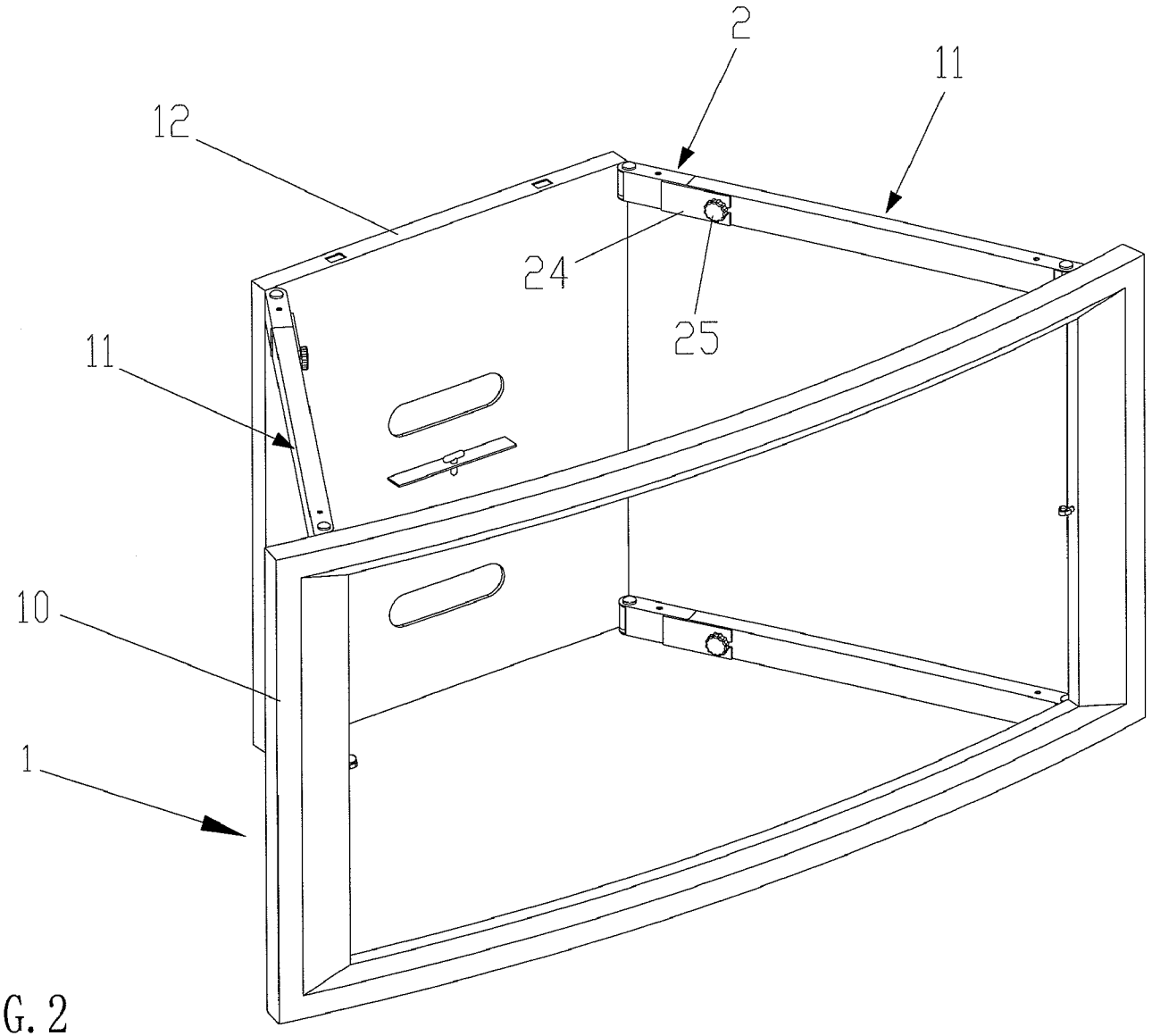
FIG. 2 is a partially perspective view of the shelving unit as shown in FIG. 1.
Figure 3:
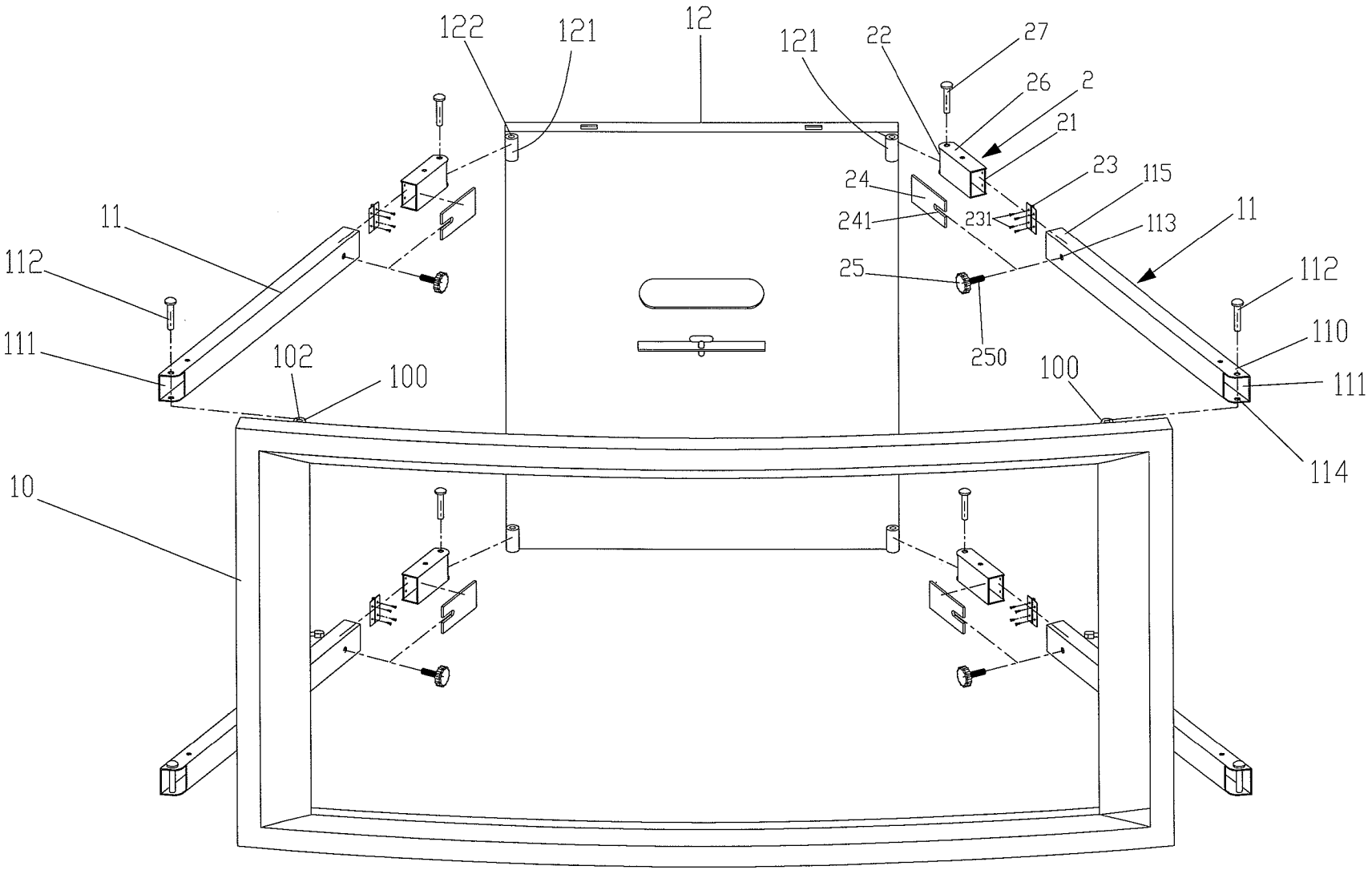
FIG. 3 is an exploded perspective view of the shelving unit as shown in FIG. 2.
Figure 4:
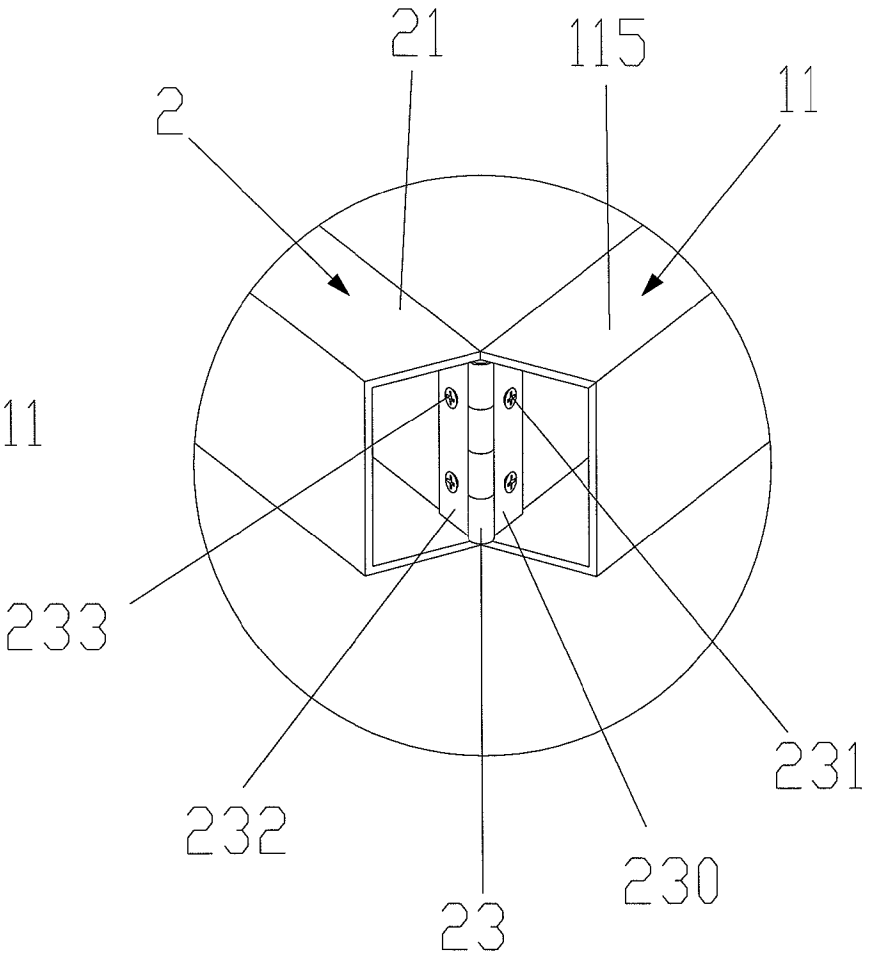
FIG. 4 is a partially perspective view of the shelving unit as shown in FIG. 2.
Figure 5:
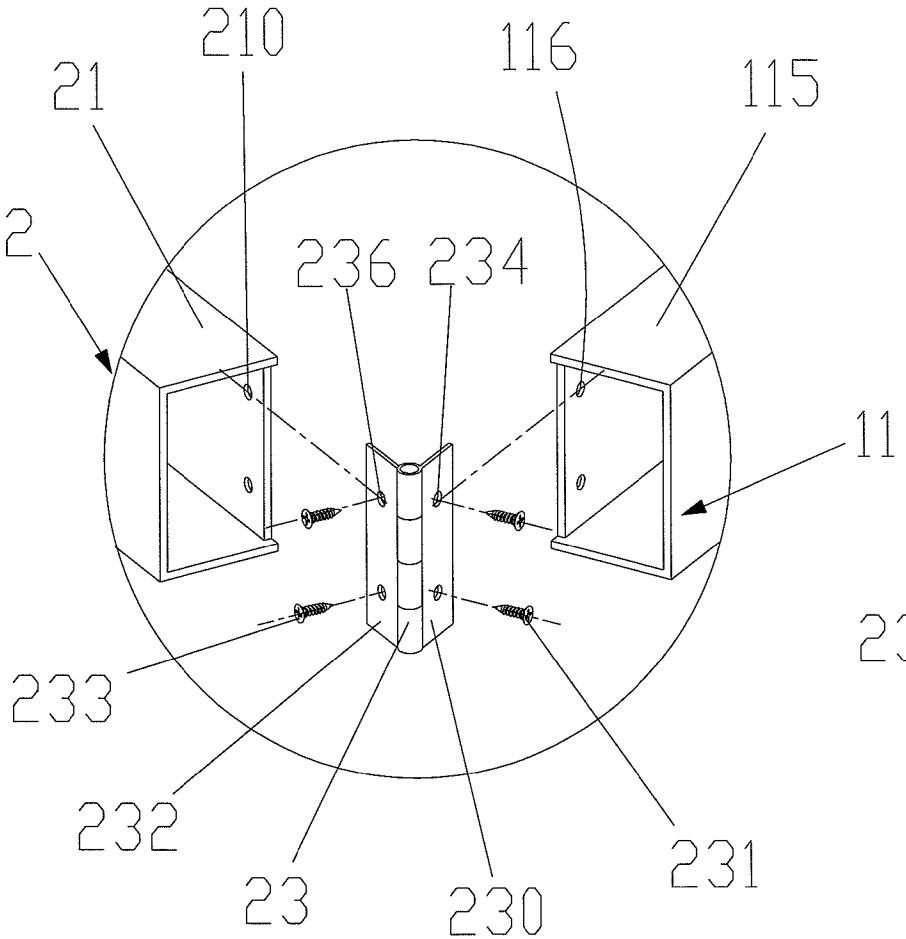
FIG. 5 is an exploded perspective view of the shelving unit as shown in FIG. 4.
Figure 7:
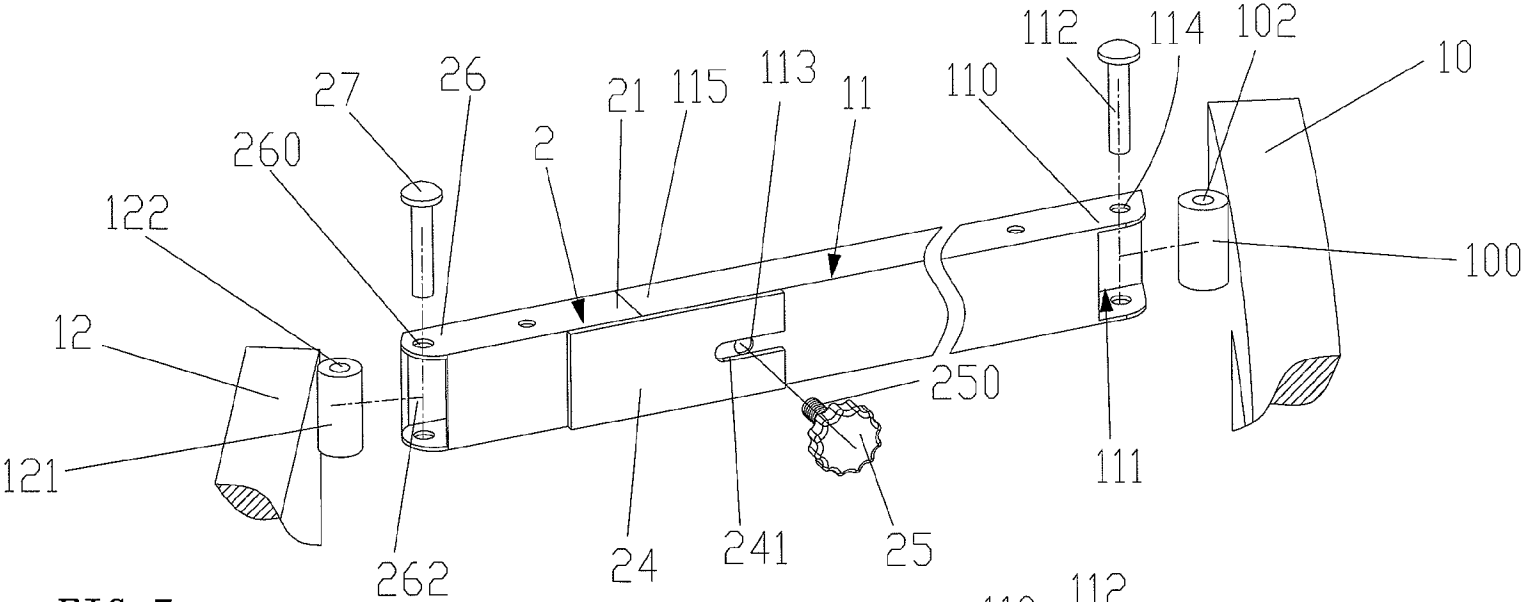
FIG. 7 is an exploded perspective view of the shelving unit as shown in FIG. 6.
Figure 6:
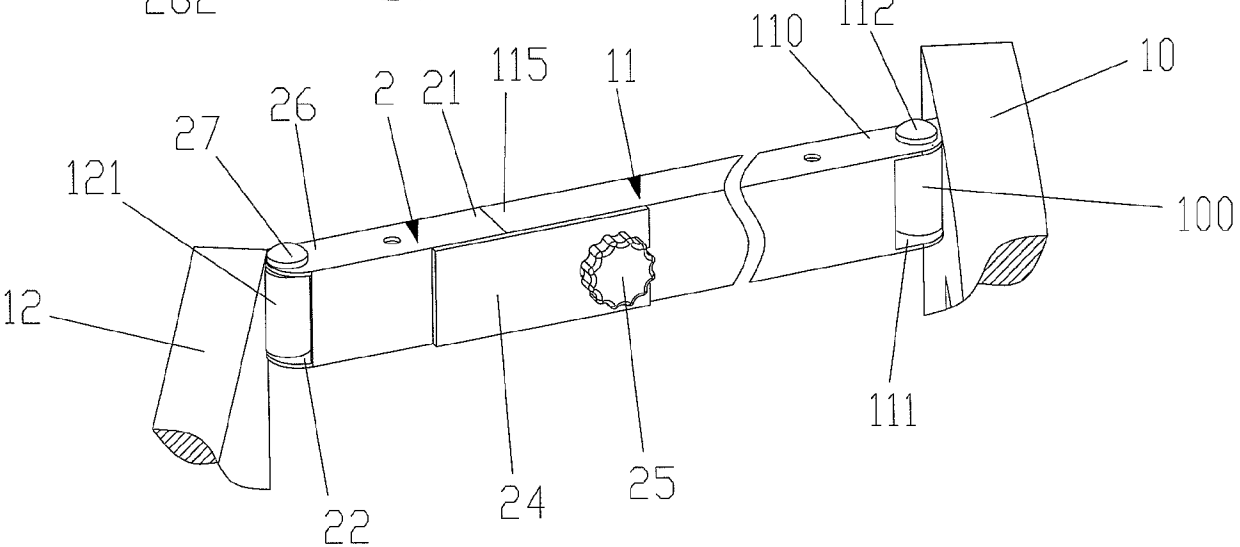
FIG. 6 is a partially perspective view of the shelving unit as shown in FIG. 2.

Referring to the drawings and initially to FIGS. 1-7, a shelving unit in accordance with the preferred embodiment of the present invention comprises a support frame 1, and a plurality of support boards 3 each detachably mounted on the support frame 1.

The support frame 1 includes a front support bracket 10 having four corners, a back board 12 located opposite to the front support bracket 10 and having four corners, four first connecting tubes 11 each having a first end pivotally connected with a respective one of the four corners of the front support bracket 10, four second connecting tubes 2 each having a first end 21 pivotally connected with a second end 115 of a respective one of the first connecting tubes 11 and a second end pivotally connected with a respective one of the four corners of the back board 12, four hinges 23 pivotally mounted between the second end 115 of a respective one of the first connecting tubes 11 and the first end 21 of a respective one of the second connecting tubes 2, four fixing plates 24 each having a first end secured on a respective one of the second connecting tubes 2, and four fastening bolts 25 each detachably mounted between a second end of a respective one of the fixing plates 24 and the second end 115 of a respective one of the first connecting tubes 11 to releasably lock the second end of the respective fixing plate 24 onto the second end 115 of the respective first connecting tube 11.

Each of the four corners of the front support bracket 10 has a side provided with a mounting post 100. The mounting post 100 of the front support bracket 10 has an inner portion provided with a pivot hole 102.

Each of the first connecting tubes 11 is pivotally mounted between the front support bracket 10 and the respective second connecting tube 2. The first end of each of the first connecting tubes 11 is provided with a hollow pivot seat 110 pivotally mounted on the respective mounting post 100 of the front support bracket 10. The pivot seat 110 of each of the first connecting tubes 11 has an inner portion provided with a mounting recess 111 to receive the respective mounting post 100 of the front support bracket 10. The pivot seat 110 of each of the first connecting tubes 11 has two opposite sides each provided with a fixing hole 114 connected to the mounting recess 111, and the support frame 1 further includes four pivot pins 112 each extending through the fixing hole 114 of the pivot seat 110 of a respective one of the first connecting tubes 11 and the pivot hole 102 of the respective mounting post 100 of the front support bracket 10, so that the pivot seat 110 of each of the first connecting tubes 11 is pivotally mounted on the respective mounting post 100 of the front support bracket 10. The second end 115 of each of the first connecting tubes 11 has a sidewall provided with at least one first screw hole 116 and has a surface provided with a threaded locking hole 113.

Each of the four corners of the back board 12 has a side provided with a mounting post 121. The mounting post 121 of the back board 12 has an inner portion provided with a pivot hole 122.

Each of the second connecting tubes 2 is pivotally mounted between the back board 12 and the respective first connecting tube 11. The first end 21 of each of the second connecting tubes 2 has a sidewall provided with at least one second screw hole 210. The second end of each of the second connecting tubes 2 is provided with a hollow pivot seat 26 pivotally mounted on the respective mounting post 122 of the back board 12. The pivot seat 26 of each of the second connecting tubes 2 has an inner portion provided with a mounting recess 262 to receive the respective mounting post 122 of the back board 12. The pivot seat 26 of each of the second connecting tubes 2 has two opposite sides each provided with a fixing hole 260 connected to the mounting recess 262, and the support frame 1 further includes four pivot pins 27 each extending through the fixing hole 260 of the pivot seat 26 of a respective one of the second connecting tubes 2 and the pivot hole 122 of the respective mounting post 122 of the back board 12, so that the pivot seat 26 of the second connecting tubes 2 is pivotally mounted on the respective mounting post 122 of the back board 12.

Each of the hinges 23 includes a first leaf 230 secured in the second end 115 of the respective first connecting tube 11 and a second leaf 232 pivotally connected with the first leaf 230 and secured in the first end 21 of the respective second connecting tube 2. The first leaf 230 of each of the hinges 23 is provided with at least one first through hole 234, the second leaf 232 of each of the hinges 23 is provided with at least one second through hole 236, and the support frame 1 further includes at least four first locking screws 231 each extending through the first through hole 234 of a respective one of the hinges 23 and each screwed into the first screw hole 116 of a respective one of the first connecting tubes 11 to lock the first leaf 230 of the respective hinge 23 in the second end 115 of the respective first connecting tube 11, and at least four second locking screws 233 each extending through the second through hole 236 of a respective one of the hinges 23 and each screwed into the second screw hole 210 of a respective one of the second connecting tubes 2 to lock the second leaf 232 of the respective hinge 23 in the first end 21 of the respective second connecting tube 2.

Each of the fixing plates 24 is secured on the respective second connecting tube 2 and is detachably mounted on the respective first connecting tube 11. The second end of each of the fixing plates 24 has an end portion provided with an elongate slot 241 aligning with the threaded locking hole 113 of the respective first connecting tube 11.

Each of the fastening bolts 25 is rotatably mounted on the respective first connecting tube 11 and abuts the respective fixing plate 24. Each of the fastening bolts 25 has a threaded shank 250 extending through the elongate slot 241 of the respective fixing plate 24 and screwed into the threaded locking hole 113 of the respective first connecting tube 11 to releasably lock the second end of the respective fixing plate 24 onto the second end 115 of the respective first connecting tube 11.

The support boards 3 are located between and supported by the front support bracket 10, the back board 12, the first connecting tubes 11 and the second connecting tubes 2.

Figure 8:
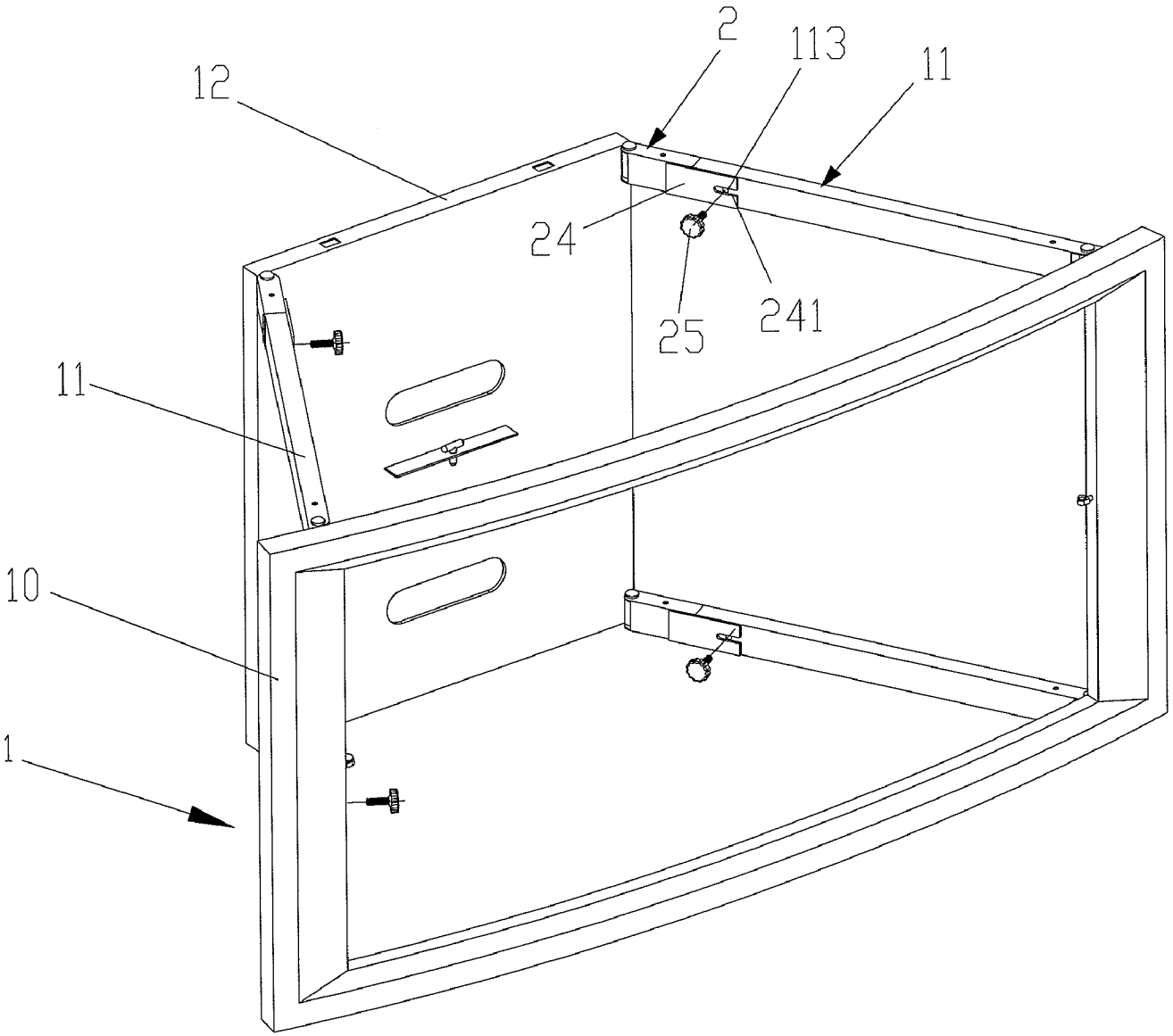
FIG. 8 is a partially exploded perspective view of the shelving unit as shown in FIG. 2.
Figure 9:
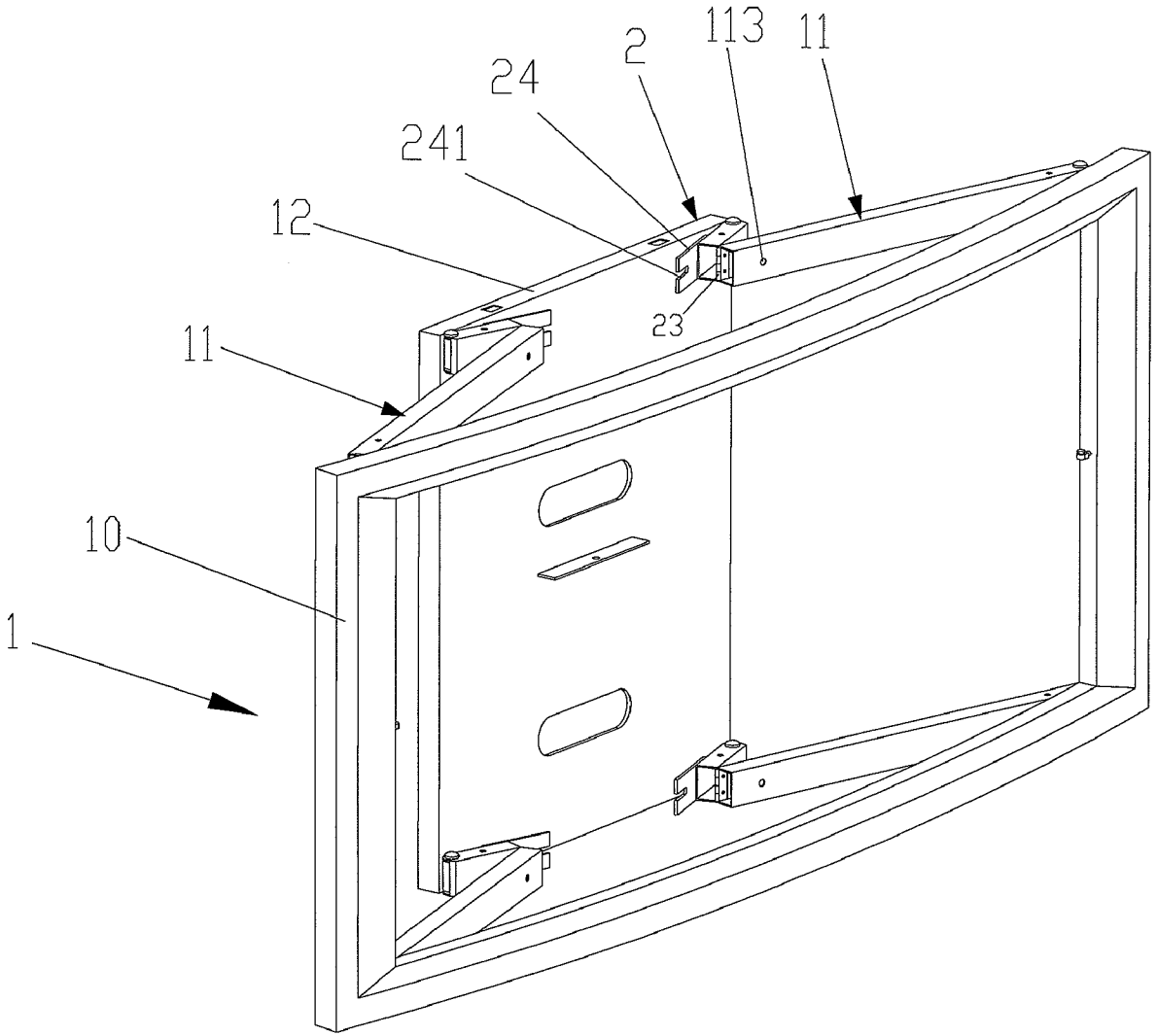
FIG. 9 is a perspective folded view of the shelving unit as shown in FIG. 8.

In operation, referring to FIGS. 8 and 9 with reference to FIGS. 1-7, when a user wishes to fold the support frame 1 of the shelving unit, each of the fastening bolts 25 is unscrewed from the threaded locking hole 113 of the respective first connecting tube 11 and is detached from the elongate slot 241 of the respective fixing plate 24 as shown in FIG. 8 to unlock the respective first connecting tube 11 from the respective fixing plate 24. Then, when the front support bracket 10 and the back board 12 are pushed toward each other, each of the first connecting tubes 11 is pivoted and moved toward the front support bracket 10, and each of the second connecting tubes 2 is pivoted relative to the respective first connecting tube 11 and is moved toward the back board 12, so that the front support bracket 10 and the back board 12 are moved toward each other so as to fold the support frame 1 as shown in FIG. 9.

Accordingly, the support frame 1 of the shelving unit can be folded to have a smaller volume to decrease the cost of packaging, transportation and storage of the shelving unit. In addition, the shelving unit can be assembled easily and quickly without using tools, thereby greatly facilitating a user assembling the shelving unit. Further, the shelving unit can be folded when not in use to save the space of storage, thereby facilitating the user storing and moving the shelving unit.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A shelving unit, comprising:

a support frame including:

a front support bracket having four corners;

a back board located opposite to the front support bracket and having four corners;

four first connecting tubes each having a first end pivotally connected with a respective one of the four corners of the front support bracket;

four second connecting tubes each having a first end pivotally connected with a second end of a respective one of the first connecting tubes and a second end pivotally connected with a respective one of the four corners of the back board;

wherein the support frame further includes:

four hinges pivotally mounted between the second end of a respective one of the first connecting tubes and the first end of a respective one of the second connecting tubes;

each of the hinges includes:

a first leaf secured in the second end of the respective first connecting tube;

a second leaf pivotally connected with the first leaf and secured in the first end of the respective second connecting tube;

the second end of each of the first connecting tubes has a sidewall provided with at least one first screw hole;

the first end of each of the second connecting tubes has a sidewall provided with at least one second screw hole;

the first leaf of each of the hinges is provided with at least one first through hole;

the second leaf of each of the hinges is provided with at least one second through hole;

the support frame further includes:

at least four first locking screws each extending through the first through hole of a respective one of the hinges and each screwed into the first screw hole of a respective one of the first connecting tubes to lock the first leaf of the respective hinge in the second end of the respective first connecting tube;

at least four second locking screws each extending through the second through hole of a respective one of the hinges and each screwed into the second screw hole of a respective one of the second connecting tubes to lock the second leaf of the respective hinge in the first end of the respective second connecting tube.

2. The shelving unit of claim 1, wherein each of the four corners of the front support bracket has a side provided with a mounting post;

the first end of each of the first connecting tubes is provided with a hollow pivot seat pivotally mounted on the respective mounting post of the front support bracket.

3. The shelving unit of claim 2, wherein the pivot seat of each of the first connecting tubes has an inner portion provided with a mounting recess to receive the respective mounting post of the front support bracket.

4. The shelving unit of claim 3, wherein the mounting post of the front support bracket has an inner portion provided with a pivot hole;

the pivot seat of each of the first connecting tubes has two opposite sides each provided with a fixing hole connected to the mounting recess;

the support frame further includes four pivot pins each extending through the fixing hole of the pivot seat of a respective one of the first connecting tubes and the pivot hole of the respective mounting post of the front support bracket, so that the pivot seat of each of the first connecting tubes is pivotally mounted on the respective mounting post of the front support bracket.

5. The shelving unit of claim 1, wherein each of the four corners of the back board has a side provided with a mounting post;

the second end of each of the second connecting tubes is provided with a hollow pivot seat pivotally mounted on the respective mounting post of the back board.

6. The shelving unit of claim 5, wherein the pivot seat of each of the second connecting tubes has an inner portion provided with a mounting recess to receive the respective mounting post of the back board.

7. The shelving unit of claim 6, wherein the mounting post of the back board has an inner portion provided with a pivot hole;

the pivot seat of each of the second connecting tubes has two opposite sides each provided with a fixing hole connected to the mounting recess;

the support frame further includes four pivot pins each extending through the fixing hole of the pivot seat of a respective one of the second connecting tubes and the pivot hole of the respective mounting post of the back board, so that the pivot seat of the second connecting tubes is pivotally mounted on the respective mounting post of the back board.

8. The shelving unit of claim 1, wherein when the front support bracket and the back board are pushed toward each other, each of the first connecting tubes is pivoted and moved toward the front support bracket, and each of the second connecting tubes is pivoted relative to the respective first connecting tube and is moved toward the back board, so that the front support bracket and the back board are moved toward each other.

9. The shelving unit of claim 1, further comprising:

a plurality of support boards each detachably mounted on the support frame.

10. The shelving unit of claim 9, wherein the support boards are located between and supported by the front support bracket, the back board, the first connecting tubes and the second connecting tubes.

11. The shelving unit of claim 1, wherein each of the first connecting tubes is pivotally mounted between the front support bracket and the respective second connecting tube.

12. The shelving unit of claim 1, wherein each of the second connecting tubes is pivotally mounted between the back board and the respective first connecting tube.

13. A shelving unit, comprising:

a support frame including:

a front support bracket having four corners;

a back board located opposite to the front support bracket and having four corners;

four first connecting tubes each having a first end pivotally connected with a respective one of the four corners of the front support bracket;

four second connecting tubes each having a first end pivotally connected with a second end of a respective one of the first connecting tubes and a second end pivotally connected with a respective one of the four corners of the back board;

wherein the support frame further includes:

four fixing plates each having a first end secured on a respective one of the second connecting tubes;

four fastening bolts each detachably mounted between a second end of a respective one of the fixing plates and the second end of a respective one of the first connecting tubes to releasably lock the second end of the respective fixing plate onto the second end of the respective first connecting tube;

the second end of each of the first connecting tubes has a surface provided with a threaded locking hole;

the second end of each of the fixing plates has an end portion provided with an elongate slot aligning with the threaded locking hole of the respective first connecting tube;

each of the fastening bolts has a threaded shank extending through the elongate slot of the respective fixing plate and screwed into the threaded locking hole of the respective first connecting tube to releasably lock the second end of the respective fixing plate onto the second end of the respective first connecting tube.

14. The shelving unit of claim 13, wherein each of the fixing plates is secured on the respective second connecting tube and is detachably mounted on the respective first connecting tube.

15. The shelving unit of claim 13, wherein each of the fastening bolts is rotatably mounted on the respective first connecting tube and abuts the respective fixing plate.

* * * * *